United States Patent [19]

Lundwall et al.

[11] Patent Number: 4,706,568

[45] Date of Patent: Nov. 17, 1987

[54] CHEMILUMINESCENT MARKING WARHEAD

[75] Inventors: Neal M. Lundwall; Donald Herigstad, both of Ridgecrest, Calif.

[73] Assignee: The United States of America as represented by the Secretary of the Navy

[21] Appl. No.: 874,311

[22] Filed: Jun. 9, 1986

[51] Int. Cl.[4] ..... F42B 13/36

[52] U.S. Cl. ..... 102/513; 362/34

[58] Field of Search ..... 102/340, 342, 351, 357, 102/458, 513; 362/34, 102

[56] References Cited

U.S. PATENT DOCUMENTS

| | | | |
|---|---|---|---|
| 3,049,080 | 8/1962 | Schermuly | 102/351 X |
| 3,498,220 | 3/1970 | Bergman | 102/340 |
| 3,515,070 | 6/1970 | Cutler et al. | 102/513 |
| 3,576,987 | 5/1971 | Voight et al. | 362/34 |
| 3,736,874 | 6/1973 | Gerber | 102/513 X |
| 3,745,324 | 7/1973 | Shefler et al. | 362/34 |
| 4,553,481 | 11/1985 | Ricci | 102/458 |

*Primary Examiner*—Samuel Scott
*Assistant Examiner*—Allen J. Flanigan
*Attorney, Agent, or Firm*—William C. Townsend; W. Thom Skeer; Peter A. Lipovsky

[57] ABSTRACT

A plurality of chemiluminescent light sources are expelled from a housing by an explosive charge in such a manner as to activate and provide a marked area.

3 Claims, 6 Drawing Figures

Fig. 1
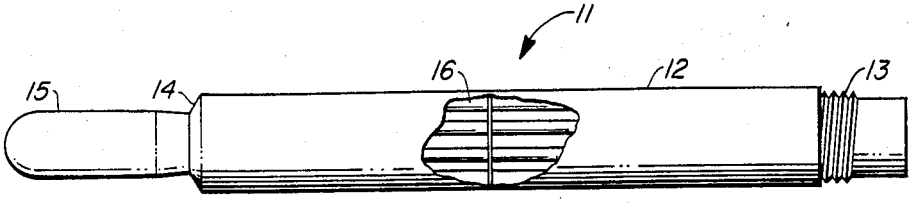
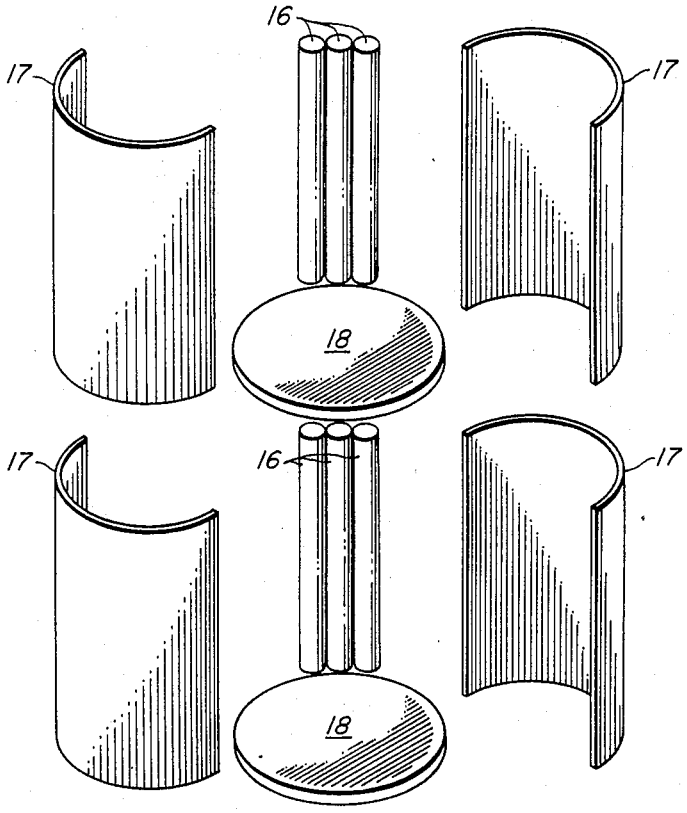
Fig. 2
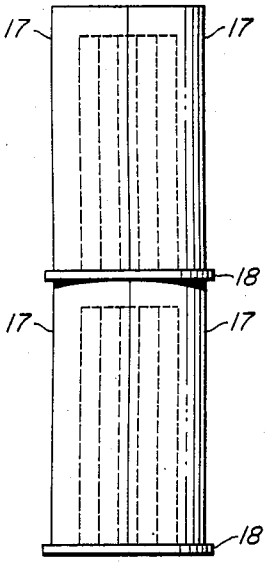
Fig. 3
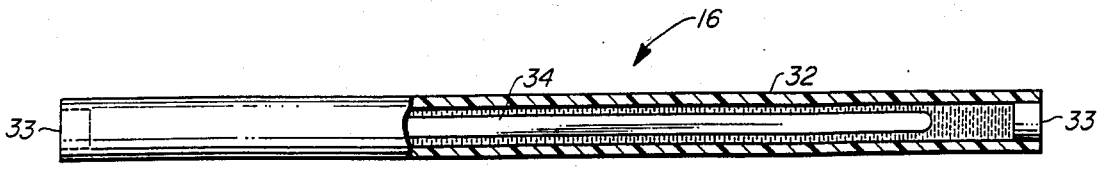
Fig. 6

CHEMILUMINESCENT MARKING WARHEAD

BACKGROUND OF THE INVENTION

1. Field of the Invention

This invention relates to the field of pharology. More specifically, this invention relates to a navigational light source to be used by aircraft. By further characterization, but without limitation thereto, this invention will be described as it relates to a chemiluminescent marking warhead to be fired from a rocket launcher carried aboard an aircraft.

2. Description of the Prior Art

During night operations, target areas and positions on the ground must be marked so that further approaches by aircraft can quickly and accurately locate the marked area. Often, such operations are carried out in a high threat environment. The airborne forward controller is vulnerable to enemy attack and when the marked area indicates the location of a downed airman or other personnel requiring rescue evacuations, known methods of marking 20 often create hazards for people in the marked area. That is, the white phosphorus flares may alert the enemy of the location of the desired target area and, additionally, such flares are difficult to store and handle and may ignite ground fires. In the past, attempts have been made to use chemiluminescent lighting that can be displayed by ground personnel. Additionally, some attempts have been made to use a chemiluminescent warhead such that it may be dropped by an aircraft to mark an area while having some standoff capability. That is, the dropping aircraft need not pass over the marked area.

Past attempts to used a chemiluminescent warhead in a standoff situation have involved the use of an especially constructed warhead which functions as a single chemiluminescent source. Although satisfactory for some purposes, a single light source has the disadvantage of being concealed by ground vegetation or falling into an area where its light is visible only in limited situations.

SUMMARY OF THE INVENTION

The present invention is directed to a chemiluminescent lighting structure which broadcasts a plurality of smaller chemiluminescent light sources over a limited area such that a wide angle of visibility is created for approaching aircraft without the dispensing of a high intensity light source as in the case of the phosphorus flares. This dispensing apparatus is characterized by having a tubular container holding a plurality of chemiluminescent sources having flexible exterior housings and a launching or dispensing mechanism within the housing to distribute the chemiluminescent units and actuate them simultaneously. The invention will be described as it pretains to an aerial launched., rocket-propelled lighting unit.

OBJECTS OF THE INVENTION

It is accordingly an object of this invention to provide a navigational light source using a plurality of chemiluminescent light generators.

A further object of this invention is the provision of a light navigation device which may be launched from an aircraft.

A further object of the present invention is to provide a safe, easily stored, long lived light source which may be safely handled and stored.

BRIEF DESCRIPTION OF THE DRAWINGS

Other objects, advantages, and novel features of the invention will become apparent from the following detailed description of the invention when considered in conjunction with the accompanying drawings wherein:

FIG. 1 is a side elevation of one embodiment of the invention;

FIG. 2 is an exploded view of a diagrammatic packaging arrangement for the light sources used in the embodiment of FIG. 1;

FIG. 3 is a assembled view of FIG. 2 showing the relationship of the parts;

FIG. 6 is a partial section of a light source used in the invention.

DESCRIPTION OF THE PREFERRED EMBODIMENT

Figure 4:
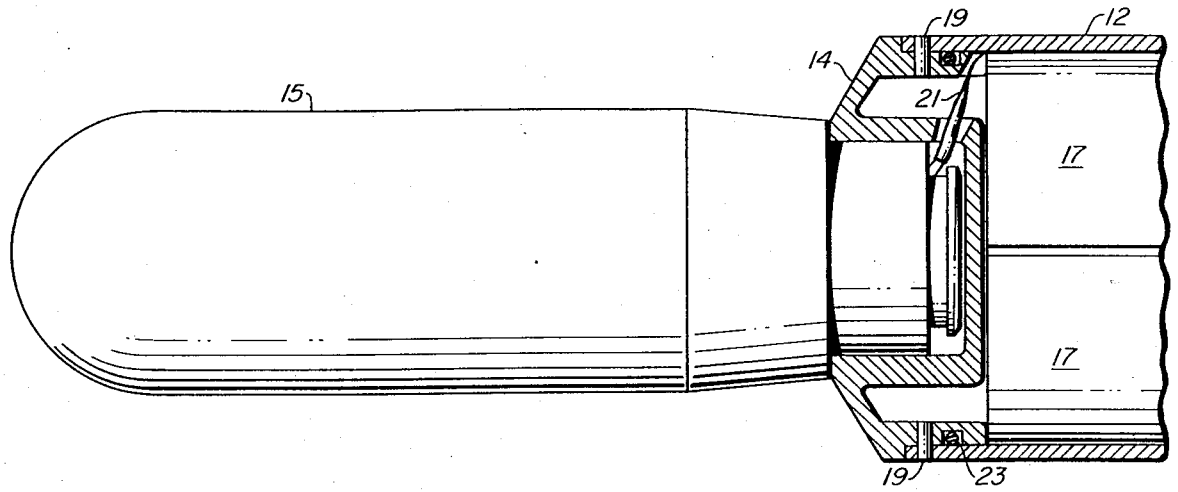
FIG. 4 is a detailed view of the forward section of an embodiment of the invention.

Referring to FIG. 1, the warhead is indicated generally at 11. The term "warhead" is used to indicate that dimensionally and functionally the light dispenser of the invention is designed to fit in the portion of a air launched missile which would be normally occupied by a warhead. There is no implication that warhead 11 contains any destructive explosives material other than a small propellant charge, to be described. Warhead 11 consists of a body 12 and aft end 13, a bulkhead or plug 14 in the forward end thereof, a fuze 15, and a plurality of light sources indicated at 16.

Referring to FIG. 2, an exploded view of a diagrammatic nature indicating the packaging techniques for the light source package of the invention is illustrated. A plurality of the light sources indicated at 16 are surrounded by pusher shell 17 and rests on a pusher plate plate 18. In the illustrated embodiment there are two sections to comprise the dispensed light package. In practice, greater numbers of pushing packages composed of pusher plates 18 and pusher shells 17 may be assembled in a common unit in depedence upon the length available. Likewise, although only three light sources 16 are illustrated in each pushing compartment a greater number will normally be used.

Referring FIG. 3 the arrangement of the assembled pusher package is shown. Shells 17 enclose light sources 16 and rest on pusher plates 18. Although the illustrated arrangement shows pusher shells 17 to be semi-cylindrical, it will be understood that the pusher shell may comprise a greater number of segments, if desired. The packaging of light sources 16 may be so as to allow some ullage which may, if desired, be packed with a light packaging material. This technique prevents actuation of light sources 16 by handling or the launch propulsive force.

Referring to FIG. 4, the details of the forward end of the light source is shown in a partial section. As illustrated, plug 14 is held to body 12 by a plurality of shear pins indicated at 19. Fuze 15 is conventionally mounted on plug 14 and may be, if desired, a proximity fuze of a well understood type. Fuze 15 is connected to a expulsion charge, to be described later, by a cable 21. Cable 21 may be any state-of-the-art electrical connector and in developmental models of the invention was a small dimensioned flat ribbon cable. Cable 21 passes between pusher shell 17 and body 12. A conventional O-ring 23 provides sealing, in the well understood fashion, between plug 14 and body 12.

Figure 5:
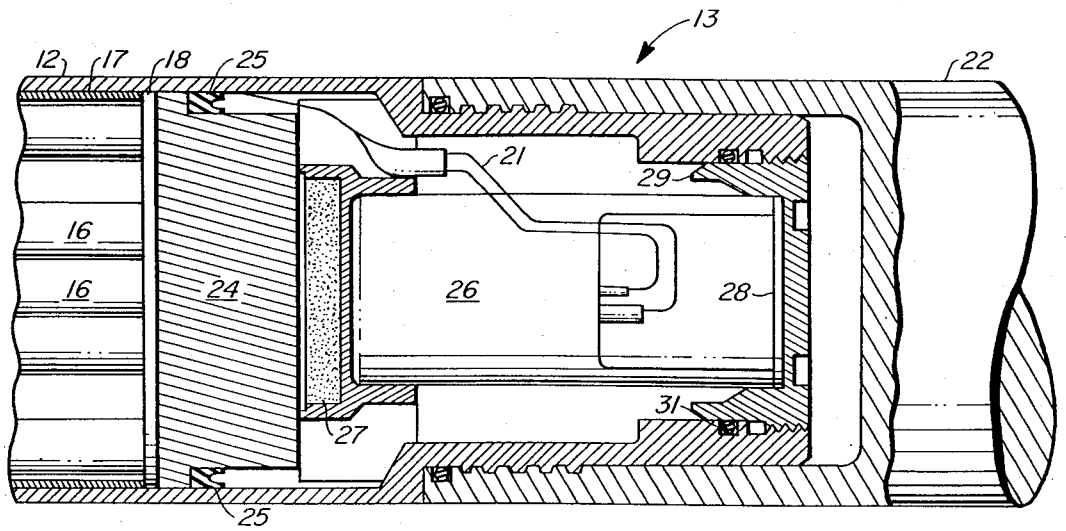
FIG. 5 is sectional view of the aft portion of an embodiment of the invention.

Referring to FIG. 5, the constructional details of the aft end 13 of the device will be described. Pusher shells 17 are shown in section to reveal the stack arrangement of light sources 16. The ends of light sources 16 contact pusher plate 18, as previously described. A pusher piston 24 backs up pusher plate 18 and is sealed to the inner wall of body 12 by means of a resilient seal 25. Cable 21 is passed between seal 25 and body 12 such that it may contact the electrical input of a conventional detonator 26. Detonator 26 is cushioned by a pad 28 and held in a place by a base 29 which is threadably received in a reduced portion of body 12. Base 29 is held to case 12 by means of threads, and sealed by an O-ring 31. As is conventional with warhead attachments, warhead 11 is attached to a rocket motor 22 by conventional threaded means.

Between detonator 26 and pusher piston 24 a small expulsion charge 27 is located. Expulsion charge 27 may be in a suitable propellant chosen to provide the necessary expansive force to drive piston 24 toward the fuze 15 with sufficient force that shear pins 19 are broken. The amount and type of propellant will depend upon the weight of the illuminating light sources 16 and the shear strength of shear pins 19. Choice among available propellants is within the skill of one versed in the art.

In operation, a propulsive force from expulsion charge 27 forces piston 24 forward and transmits the shearing force laong pusher shells 17 to plug 14 where pins 19 are sheared and fuze 15 and plug 14 are broken away from body 12 by this action. Further forward movement of piston 24 ejects light sources 16 and pusher shells 17 which fall away such that light sources are distributed over the desired area. In developmental models, a chemiluminescent light source known in the art as a light stick was employed.

Referring to FIG. 6, the details of light sources 16 are illustrated. These light sources are variations of commercial products made by the American Cyanamid Co. of Havre de Grace, Md. The construction is characterized by transparent flexible polyethylene tube 32 having ends 33 sealing tube 32 to provide for storage of a green oxalate ester/fluorescer solution. A glass ampule 34 is also housed within tube 32 such that pressure on tube 32 breaks ampule 34 allowing the oxidizer contained therein to activate the fluorescer solution.

In developmental models this chemiluminescence was in the visible range however, it should be noted that light sources in ranges invisible to the human eye may be utilized, if desired. Likewise, other visible spectrums may be produced which is visible to both human vision and electronically assisted optical detectors.

Likewise, although disclosed as a payload for a rocket engine, it should be apparent that with a minimum of modification the light dispenser may be fitted on other bases and ignited by other than fuze 15 to produce a ground actuated device. Similarly, the light sources 16 illustrated are constructed such that an ejection into the slip stream of the travelling rocket causes sufficient flexure to initiate the fluorescizing action. For ground or stationery embodiments expulsion charge 27 may be increased in strength or the relative positions and sizes of pusher plates 18 may be changed to provide the necessary chemiluminescent initiation action upon explosion. Further modifications may be made by employing good engineering practice within the scope of the appended claims.

The afore description, taken together with the appended claims, constitutes a disclosure such as to enable a person skilled in the ordnance arts and having the benefit of the teachings contained herein to make and use the invention. Further, the structure herein described meets the afore-stated objects of invention, and generally constitutes a meritorious advance in the art unobvious to such a worker not having the benefit of these teachings.

What is claimed is:

1. A chemiluminescent marking system comprising:

housing means having smooth interior walls;

slidable closure means located at one end of said housing means and in engagement with said interior walls of said housing means;

a plug means releaseably attached to said housing means at an end thereof remote from said slidable closure means;

a plurality of chemiluminescent radiant energy sources within said housing between said plug means and said slidable closure means, each of said chemiluminescent radiant energy sources being characterized by having;

a flexible outer wall containing a component chemical of a chemiluminescent reaction, and a frangible inner vessel containing another component of said chemiluminescent reaction, where by flexure of said outer wall causes rupture of said frangible inner vessel to initiate said chemiluminescent reaction, and means to move said slidable closure means toward said plug means to cause separation of said plug means to release said chemiluminescent radiant energy sources in such a manner to cause flexure of said outer wall to start said chemiluminescent reaction.

2. A chemiluminescent marking device comprising:

a hollow tubular housing;

a fuze attached to one end of said tubular housing for initiating said marking device in response to predefined conditions;

a bulkhead closing one end of said housing and positioned adjacent said fuze;

an explosive charge attached to said housing at the end thereof remote from said fuze;

a piston mounted adjacent said explosive charge and internal of said housing and in sealing relationship with the inner surfaces of said housing;

a plurality of liner segments within said housing and adjacent said piston and configured to lie adjacent the interior of said housing so as to define a first compartment therein;

a first plurality of self-contained chemiluminescent radiant energy sources within said first compartment and configured to emit radiation upon the application of mechanical energy contained within said housing adjacent said piston;

slidable bulkhead means disposed within said housing and in engagement with said plurality of liner segments remote from said piston;

additional liner segments adjacent said slidable bulkhead means and configured to lie along the interior of said housing so as to define at least one additional compartment within said housing;

a further plurality of self-contained chemiluminescent radiant energy sources filling all other compartments formed by said additional liner segments and said slidable bulkhead means;

connection means effectively joining said fuze and said explosive charge to cause actuation thereby, whereby said explosive charge ejects said piston, said slidable bulkhead means, said liner segments, and said plurality of chemiluminescent radiant energy sources from said housing.

3. A chemiluminescent marking warhead for providing a night reference for air navigation, comprising:

a rocket motor;

a hollow tubular housing configured for attachment to said rocket motor;

an explosive charge within said housing adjacent said rocket motor;

a fuze attached to one end of said housing for initiating said warhead in response to predefined conditions;

a bulkhead closing one end of said housing supporting and adjacent to said fuze and attached to said housing by shearable means;

a piston mounted over said explosive charge and sealingly contacting the inner walls of said housing;

a first plurality of liners disposed in said housing in contact with said piston and defining a first compartment;

a first plurality of elongated chemiluminescent light sticks, each having a frangible inner container containing a first chemical and a second flexible container containing said first container and a second chemical, said first plurality of light sticks being disposed in said first compartment;

a slidable bulkhead disposed in said housing in contact with said first plurality of liners;

a second plurality of liners disposed in said housing in contact with said slidable bulkhead and defining a second compartment; and a second plurality of elongated chemiluminescent light sticks identical in construction to said first plurality of light sticks and disposed in said second compartment, whereby initiation by said fuze causes said explosive charge to propel said piston toward the front of said housing, shearing the bulkhead and expelling the lightsticks into the airstream where they are caused to flex, rupturing the first container and activating the lightsticks which provide an illuminated reference marking.

* * * * *